US006592437B1

(12) United States Patent
Boyd et al.

(10) Patent No.: US 6,592,437 B1
(45) Date of Patent: Jul. 15, 2003

(54) ACTIVE GIMBAL RING WITH INTERNAL GEL AND METHODS FOR MAKING SAME

(75) Inventors: John M. Boyd, Atascadero, CA (US); Allan Paterson, Austin, TX (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/033,479

(22) Filed: Dec. 26, 2001

(51) Int. Cl.[7] ..... B24B 5/00
(52) U.S. Cl. ..... 451/285; 451/398; 451/288
(58) Field of Search ..... 451/285, 289, 451/397, 398, 364, 286, 287, 288, 290, 41, 63

(56) References Cited

U.S. PATENT DOCUMENTS

| | | | | | |
|---|---|---|---|---|---|
| 3,874,123 | A | | 4/1975 | Patentee | 51/120 |
| 4,197,676 | A | | 4/1980 | Sauerland | 51/165 R |
| 4,517,768 | A | * | 5/1985 | Hausermann et al. | 451/163 |
| 4,600,469 | A | | 7/1986 | Fusco et al. | 156/636 |
| 4,941,293 | A | * | 7/1990 | Ekhoff | 451/342 |
| 5,287,663 | A | | 2/1994 | Pierce et al. | 51/401 |
| 5,508,077 | A | | 4/1996 | Chen et al. | 428/64.3 |
| 5,672,096 | A | * | 9/1997 | Amarosa et al. | 451/504 |
| 5,975,998 | A | * | 11/1999 | Olmstead | 451/288 |
| 5,985,094 | A | | 11/1999 | Mosca | 156/345 |
| 5,993,302 | A | | 11/1999 | Chen et al. | 451/285 |
| 6,012,964 | A | | 1/2000 | Arai et al. | 451/5 |
| 6,030,488 | A | | 2/2000 | Izumi et al. | 156/345 |
| 6,056,632 | A | | 5/2000 | Mitchel et al. | 451/288 |
| 6,095,900 | A | | 8/2000 | Fruitman et al. | 451/28 |
| 6,110,026 | A | | 8/2000 | Arai | 451/289 |
| 6,145,849 | A | * | 11/2000 | Bae et al. | 279/4.07 |
| 6,149,506 | A | * | 11/2000 | Duescher | 451/59 |
| 6,358,118 | B1 | * | 3/2002 | Boehm et al. | 451/24 |

* cited by examiner

*Primary Examiner*—Joseph J. Hail, III
*Assistant Examiner*—Hadi Shakeri
(74) *Attorney, Agent, or Firm*—Martine & Penilla, LLP

(57) ABSTRACT

A chemical mechanical planarization (CMP) system having a polishing pad, a carrier plate and a wafer plate is provided with an active gimbal. The active gimbal is defined by a circular hollow ring having a wall thickness and a diameter. The circular hollow ring is configured by an elastomeric material for placement in a space between the carrier plate and the wafer plate, and the space preferably is defined in part by a cavity tightly receiving the ring. The circular hollow ring is filled with a gel-like material that flows from one portion of the ring that is squeezed and deformed when the wafer plate tilts relative to the carrier plate. The flow is to another portion of the ring that returns to an original configuration during such tilting. Methods of making the gimbal include operations for selecting materials for the hollow ring and the gel-like material.

17 Claims, 7 Drawing Sheets

ACTIVE GIMBAL RING WITH INTERNAL GEL AND METHODS FOR MAKING SAME

BACKGROUND OF THE INVENTION

1. Field of the Invention

The present invention relates generally to chemical mechanical planarization (CMP) systems and techniques for improving the performance and effectiveness of CMP operations. Specifically, the present invention relates to a hollow annular gimbal ring having internal gel suitable for providing gimbal movement of a wafer carrier plate relative to a carrier head.

2. Description of the Related Art

In the fabrication of semiconductor devices, there is a need to perform CMP operations. Typically, integrated circuit devices are in the form of multi-level structures. At the substrate level, transistor devices having diffusion regions are formed. In subsequent levels, interconnect metallization lines are patterned and electrically connected to the transistor devices to define the desired functional device. As is well known, patterned conductive layers are insulated from other conductive layers by dielectric materials, such as silicon dioxide. At each metallization level and/or associated dielectric layer, there is a need to planarize the metal and/or dielectric material. Without planarization, fabrication of additional metallization layers becomes substantially more difficult due to higher variations in the surface topography. In other applications, metallization line patterns are formed in the dielectric material, and then metal CMP operations are performed to remove overburden materials, such as copper metallization.

In the prior art, CMP systems typically implement belt, orbital, or brush stations in which belts, pads, or brushes are used to polish, buff, and scrub one or both sides of a wafer. Slurry is used to facilitate and enhance the CMP operation, and may be distributed by a combination of the movement of the preparation surface, the movement of the semiconductor wafer and the friction created between the semiconductor wafer and the preparation surface.

In a typical CMP system, a wafer is mounted on a carrier head, which rotates in a direction of rotation. The CMP process is achieved when an exposed surface of the rotating wafer is applied with force against a polishing pad, which moves or rotates in a polishing pad direction. Some CMP processes require that a significant force be used at the time the rotating wafer is being polished by the polishing pad.

Normally, the polishing pads used in the CMP systems are composed of porous or fibrous materials. Depending on the type of the polishing pad used, slurry composed of an aqueous solution containing different types of dispersed abrasive particles such as $SiO_2$ and/or $Al_2O_3$ may be applied to the polishing pad, thereby creating an abrasive chemical solution between the polishing pad and the wafer.

FIG. 1A depicts a schematic cross-sectional view of an exemplary prior art CMP system. In this CMP system a carrier head 100 engages a retaining ring mounting plate 101 provided with a retaining ring 102. The retaining ring 102 centers a wafer 103 relative to a vertical axis of rotation 104 of the carrier head 100. The carrier head 100 is urged toward a surface 106 of a polishing pad 107 with a force F. As shown, an outer surface 108 of the retaining ring 102 is positioned above an exposed surface 109 of the wafer 103. Thus, while the exposed surface 109 of the wafer 103 is in contact with the polishing pad surface 106, the outer surface 108 of the retaining ring 101 is configured to not come into contact with the polishing pad surface 106, and is thus spaced from the polishing pad surface 106. The spacing of the ring 102 from the surface 106 allows room for the wafer 103, the mounting plate 101, and the ring 102 to tilt relative to the vertical axis 104 on which the carrier head 100 rotates. A typical gimbal 111 is provided as a spherical member 112 mounted in spherical sockets 113*a* and 113*b* of the respective carrier head 100 and mounting plate 101. One or the other of the sockets 113*a* or 113*b* is configured to secure the member 112 to the respective carrier head 100 or mounting plate 101.

FIG. 1B shows the tilt of the wafer 103, the mounting plate 101, and the retaining ring 102 allowed by the gimbal 111 in terms of an angle 116 between the vertical axis 104 and an axis of rotation 117 of the retaining ring mounting plate 101. The tilt allows movement of the mounting plate 101 for parallelism of a plane (represented by a line 118) of the exposed surface 109 of the wafer 103 and a plane (represented by a line 119) of the surface 106 of the pad 107.

Several problems may be encountered while using an "edge-effect" caused by the CMP system polishing the edge of the wafer 103 at a different rate than other regions, thereby creating a non-uniform profile on the surface of the wafer 103. The problems associated with edge-effect are twofold, namely "pad rebound effect" and "edge burn-off effect." FIG. 1C is an enlarged illustration of the pad rebound effect associated with the prior art. The pad rebound effect occurs when the polishing pad surface 106 initially comes into contact with the edge of the wafer 103, causing the polishing pad surface 106 to bounce off the exposed surface 109 of the wafer 103. As the moving polishing pad surface 106 shifts under the exposed surface 109 of the wafer 103 (see arrow 120), the edge of the wafer 103 cuts into the polishing pad 107 at an edge contact zone 121. The cutting causes the polishing pad 106 to bounce off the wafer 103, thereby creating a wave on the polishing pad 106 as shown in FIG. 1C. Ideally, the polishing pad 107 is configured to be applied to the wafer 103 at a specific uniform pressure and to remain flat (planar). However, FIG. 1C shows that the wave created on the polishing pad 103 creates a series of low-pressure regions of the exposed surface 109 of the wafer 103. Such regions may include an edge non-contact zone 122 and an inner non-contact zone 123, wherein the removal rate is lower than the average removal rate. Thus, the edge contact zone 121 and an inner contact zone 124 of the wafer 103 are polished more than the other zones. As a result, the CMP processed wafer 103 will tend to show a non-uniform profile.

Further illustrated in FIG. 1D is the "edge burn-off" effect. As the polishing pad surface 106 comes into contact with the sharper edge of the wafer 103 at the edge contact zone 121, the edge of the wafer 103 cuts into the polishing pad 107, thereby creating an area defined as a "hot spot," wherein the pressure exerted by the polishing pad 107 is higher than the average polishing pressure. Thus, the polishing pad surface 106 excessively polishes the edge of the wafer 103 and the area around the edge contact zone 121 (i.e., the hot spots). By the burn-off effect, a substantially high removal rate is exhibited at the area within about 1 millimeter to about 3 millimeters of the edge of the wafer 103. Moreover, depending on the polisher and the hardware construction, a substantially low removal rate is detected within the edge non-contact zone 122, an area between about 3 millimeters to about 20 millimeters of the edge of the wafer 103. Accordingly, as a cumulative result of the edge-effects, an area of about 1 millimeter to about 20 millimeters of the edge of the resulting post-CMP wafers 103 sometimes could be rendered unusable, thereby wasting silicon device area.

One way to compensate against edge effects is to use a gimbal, such as the gimbal 111. However, such gimbals 111 also suffer problems in that the complexity of the mechanical components of such gimbals makes them difficult to design and implement for symmetric repetitive CMP environments. For example, some typical gimbals 111 tend to vibrate in response to the forces of the polishing pad 107 and the wafer 103. The vibrations may introduce numerous potential problems to troubleshot when inappropriate CMP results start appearing in processed wafers 103. Thus, the vibrations may be difficult to reproduce or analyze, making it difficult to eliminate the inappropriate CMP results.

In view of the foregoing, a need exists in the art for a chemical mechanical planarization system that substantially eliminates damaging edge-effects and their associated removal rate non-uniformities. Such need includes provision of an improved gimbal that is subject to reduced vibrations and that simplifies the design of the carrier head 100.

SUMMARY OF THE INVENTION

Broadly speaking, the present invention fills these needs by providing a chemical mechanical planarization (CMP) system having a carrier body for applying force along a central axis and a retainer body for holding a wafer centered on the axis, wherein the carrier body and the retainer body each define a perimeter edge and a plane. The planes are separated by a space having a uniform dimension when the planes are parallel and having a non-uniform dimension when the planes are not parallel. An active gimbal is received in the space and configured with a hollow annular body having an arcuate wall structure extending around and radially spaced from the central axis. The wall structure is configured with a first section generally at one side of the axis and adjacent to the perimeter edges and with an opposite section generally at an opposite side of the axis and adjacent to the perimeter edges. With the active gimbal in the space separating the planes, the first and second sections of the arcuate wall structure are unevenly deformed when the space has the non-uniform dimension. To complete the active gimbal a gel-like material fills the hollow wall structure so that when the first and second sections are unevenly deformed a portion of the gel is caused by the deformed first section to flow in the hollow annular body from the one side of the axis to the second section to fill the deformed second section with the gel while allowing the deformed first section to remain filled with another portion of the gel. It should be appreciated that the present invention can be implemented in numerous ways, including as a process, an apparatus, a system, a device, or a method. Several inventive embodiments of the present invention are described below.

In one embodiment, an active gimbal allows the space between the carrier plate and the wafer support to vary in configuration as the carrier plate and the wafer support plate tilt during CMP processing. The active gimbal may be configured as a hollow toroidally-shaped body for reception in the carrier plate-wafer support space between the carrier plane and the support plane. The body has an arcuate wall structure extending around and radially spaced from a co-axial center of the carrier plate and the wafer support plate. The toriodally-shaped body is configured so that a diameter of the body divides the body into a first half that is squeezed when the planes are not parallel and into a second half that is permitted to expand when the planes are not parallel. The first and second halves are configured to encompass substantially equal volumes when the planes are parallel and to encompass substantially unequal volumes when the planes are not parallel. The sum of the unequal volumes substantially equals the sum of the equal volumes. A gel, or gel-like material, is received in and fills the hollow toroidally-shaped body. The gel-like material is substantially incompressible so that as the first and second halves of the hollow body encompass the substantially unequal volumes, the gel-like material is caused to flow in the hollow body from the first half to the second half to fill the encompassed unequal volumes. The gel-like material in the unequal volumes serves to maintain the hollow toroidally-shaped body in contact with each of the carrier plane and the support plane when the planes are not parallel.

In still another embodiment, a method is provided for making a gimbal for use in a CMP carrier head. The gimbal is configured to be positioned between the carrier head and a wafer carrier. A first operation selects an elastomeric material having compression and decompression characteristics suitable for response to CMP forces. Another operation configures a hollow annular ring for reception in a cavity defined in opposed spaced surfaces of the carrier head and the wafer plate. The ring is configured from the selected elastomeric material. Another operation selects a gel-like material having a viscosity suitable for dampening the CMP forces applied to the carrier head and the wafer plate. A final operation fills the hollow annular ring with the selected gel-like material.

In yet another embodiment, there is a method of making an active gimbal for allowing the wafer support plate to tilt with respect to the carrier plate during CMP processing. An operation of the method configures a hollow body for reception in the space between the carrier plate and the wafer support. The configuring provides the body with a toroidal shape defined by an arcuate wall structure extending around and radially spaced from a co-axial center of the carrier plate and the wafer support. The toriodally-shaped body is configured so that a diameter of the body divides the body into a first half and a second half. The first half is squeezed when planes defined by the respective carrier plate and wafer support are not parallel. The second half is permitted to expand when the planes are not parallel. This configuring allows the first and second halves to encompass substantially equal volumes when the planes are parallel and to encompass substantially unequal volumes when the planes are not parallel. In a filling operation, the hollow toroidally-shaped body is filled with a gel-like material that is substantially incompressible. The filled hollow toroidally-shaped body is placed in the space between the carrier plate and the wafer support. As the first and second halves encompass the substantially unequal volumes when the planes are not parallel, a portion of the gel-like material is caused to flow in the hollow body from the first half to the second half to fill the encompassed unequal volumes. The gel-like material in the unequal volumes maintains the hollow toroidally-shaped body in contact with each of the carrier plane and the support plane when the planes are not parallel.

In still another embodiment, the filling operation is performed with the gel-like material having a viscosity greater than that of water to impede but still permit flow of the gel-like material from a smaller of the unequal volumes to a larger of the unequal volumes when the planes not parallel.

The advantages of the present invention are numerous. Most notably, the active gimbal of the present invention is easy to make and assemble with the carrier plate and the wafer support. Furthermore, once the material for the hollow body has been selected, the deformation of the hollow body in response to equal forces does not change over time, as the selected elastomer material retains the characteristic of returning to its original undeformed shape. Also, once the material for the gel-like material has been selected, the flow of the gel-like material within the hollow body does not change over time in response to the same forces of the hollow body, because the viscosity of the selected gel-like material remains the same. The gel-like material thus serves to maintain the hollow body in contact with each of the carrier plane and the support plane as the planes move into and out of parallel. Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings, in which like reference numerals designate like structural elements.

DETAILED DESCRIPTION OF THE PREFERRED EMBODIMENTS

The present invention defines an active gimbal. The active gimbal is preferably designed from an elastomeric material. In one embodiment, the material is configured in the shape of a hollow toroid, or hollow annular member. To provide the gimbal with active characteristics that firmly support the carrier plate and wafer plate in variable-spaced relationship, a gel-like material is received in and fills the hollow body. As will be described below, different CMP processes will subject a wafer plate to different forces. As an advantage of the present invention, the deformability of the elastomeric, polymer material, coupled with the viscosity of the gel-like material, are preferably provided to allow a smooth gimballing action of the carrier plate relative to the wafer plate while dampening some of the different forces. As a result, in response to the different forces, the active gimbal will enable the carrier plate to tilt relative to the wafer plate so that an exposed surface of the wafer and a polishing surface of a polishing pad will stay substantially co-planar to reduce wafer edge effects. In the following description, numerous specific details are set forth in order to provide a thorough understanding of the present invention. It will be understood, however, to one skilled in the art, that the present invention may be practiced without some or all of these details. In other instances, well-known process operations have not been described in detail in order not to obscure the present invention.

Figure 1A:
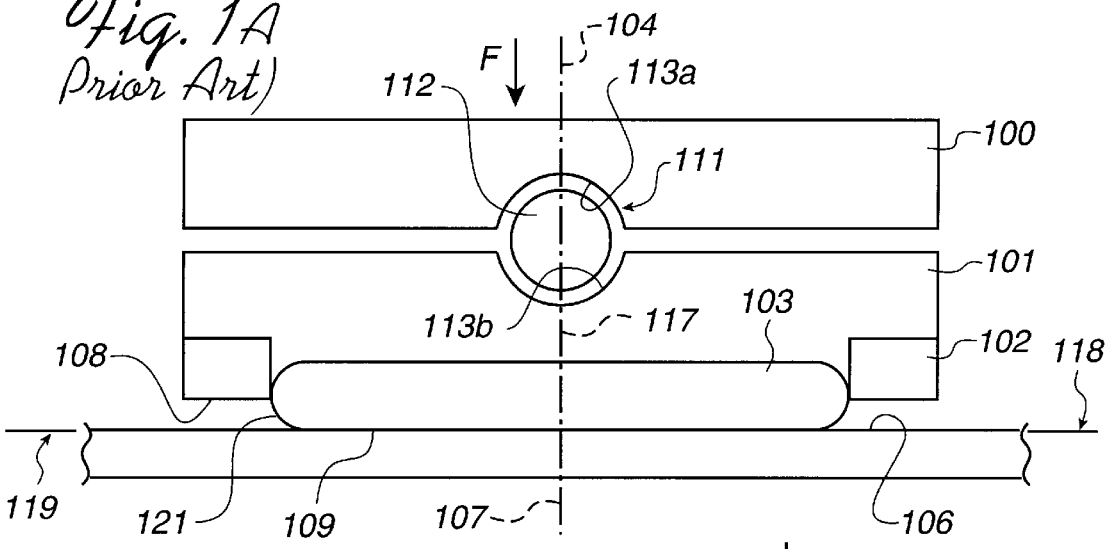
Fig. 1A (Prior Art)
FIG. 1A is an illustration of a prior art CMP system.
Figure 1B:
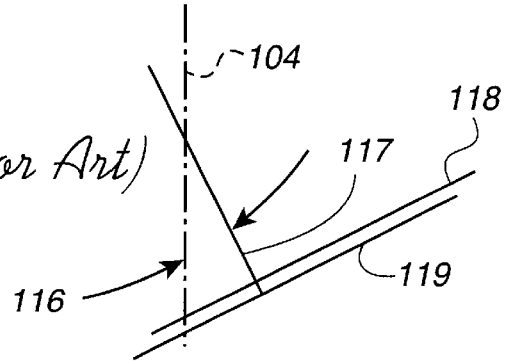
Fig. 1B (Prior Art)
FIG. 1B is an illustration of the tilting of a carrier plate axis relative to a wafer support axis in the system of FIG. 1A.
Figure 1C:
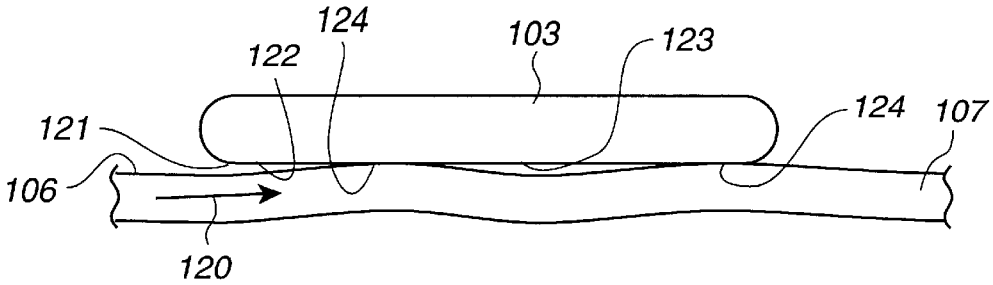
Fig. 1C (Prior Art)
FIG. 1C is an illustration of the pad rebound effect associated with the prior art.
Figure 1D:
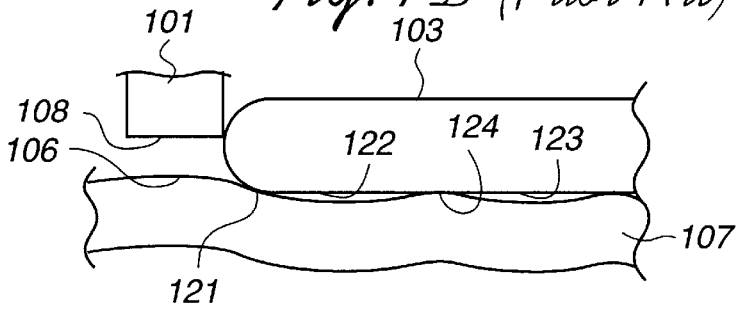
Fig. 1D (Prior Art)
FIG. 1D is an illustration of the edge burn-off effect associated with the prior art.
Figure 2:
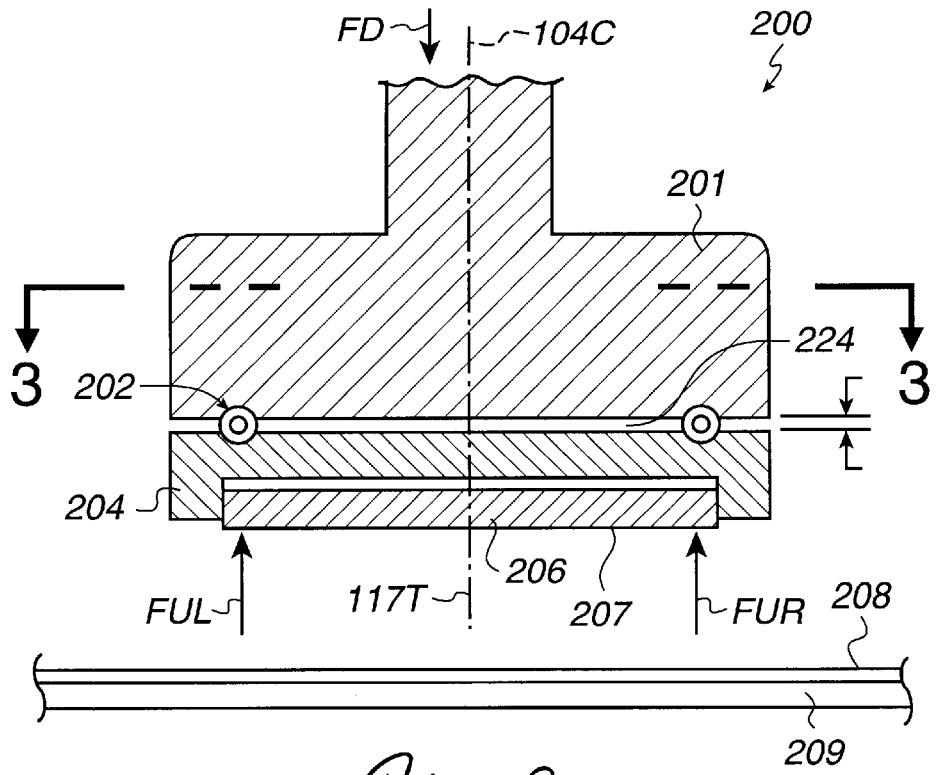
FIG. 2 is a cross sectional view of a wafer carrier system in accordance with one embodiment of the present invention.
Figure 5:
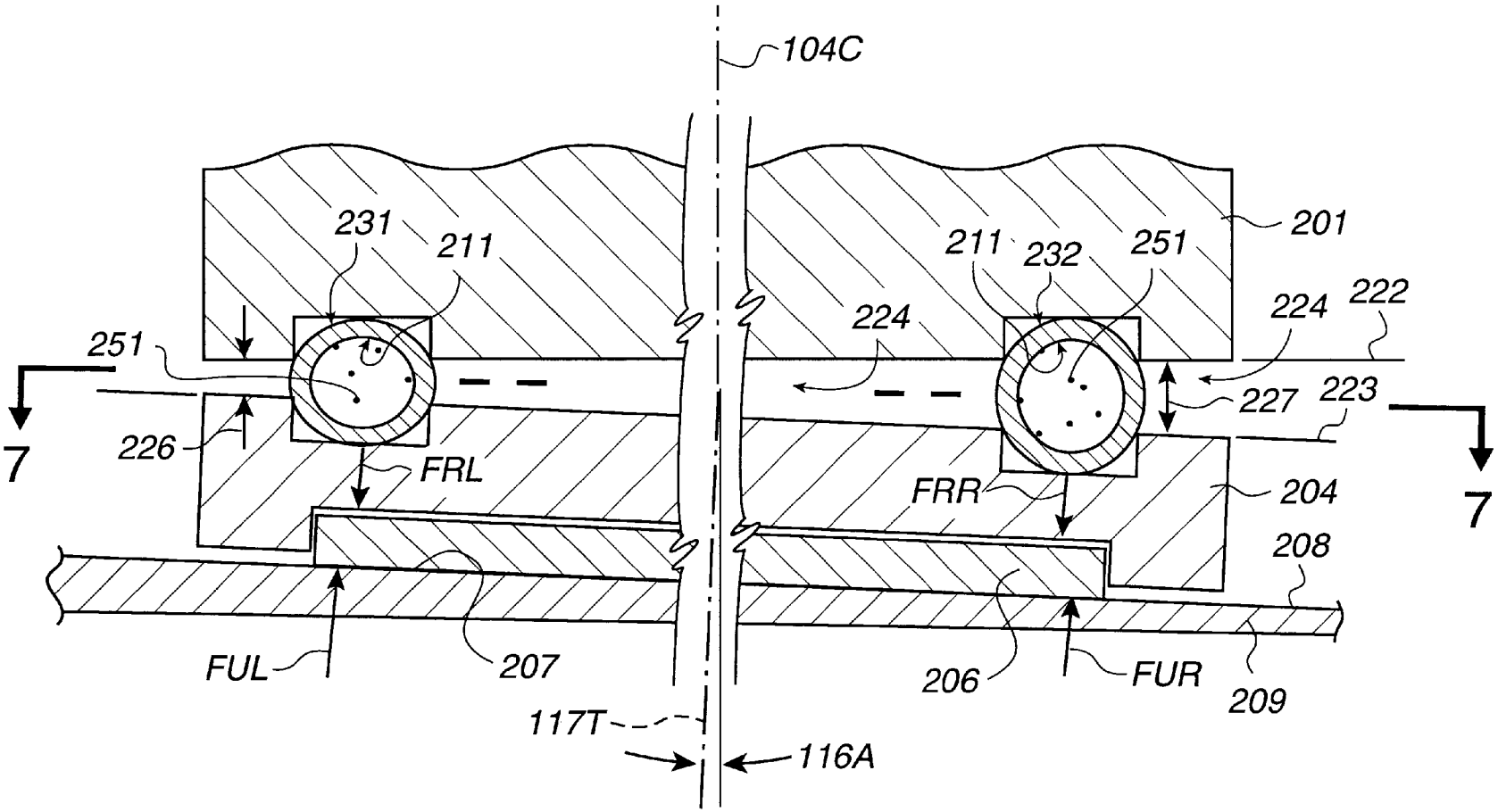
FIG. 5 is a view similar to FIG. 4 illustrating the plane defined by the wafer plate tilted with respect to the plane defined by the carrier plate, the planes being out-of-parallel so that the first portion of the hollow body has a squeezed, or deformed, smaller cross section as compared to the cross section of the second portion of the hollow body.

FIG. 2 illustrates a wafer carrier system 200 in accordance with one embodiment of the present invention. The wafer carrier system 200 includes a carrier plate 201, an active gimbal 202 and a wafer plate 204. The system 200 is used with a wafer 206 retained on the wafer plate 204 during planarization operations. Consistent with the above description of a CMP operation, when the system 200 positions the wafer 206 above a polishing pad, the carrier plate 201 is configured to apply a downward force FD urging an exposed surface 207 of the wafer 206 against a polishing surface 208 of a polishing pad 209. The carrier plate 201 may have a central axis 104C and the wafer plate 204 may have a co-axial axis 117T, which may tilt relative to each other in response to an upward force FUL of the pad 209 on the left of the wafer 206 and an upward force FUR of the pad 209 on the right of the wafer 206. The tilting of the axes 104C and 117T results from unequal values of the upward forces applied laterally spaced from the axis 117T on the wafer 206, e.g., as shown in FIG. 5 when the force FUL exceeds the force FUR. The polishing pad 209 can be any type of polishing pad such as a belt type pad, or a table type pad, for example.

Figure 6A:
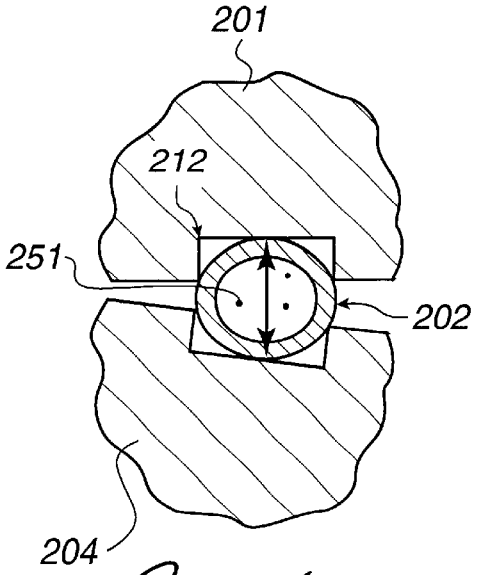
FIGS. 6A, 6B, 6C and 6D are a series of cross-sectional views taken in FIG. 3 along respective lines 6A—6A, 6B—6B, 6C—6C, and 6D—6D illustrating progressively decreased amounts of the squeezing of the hollow body from a far left section of the body to a far right section of the body in FIG. 3, wherein the space between the planes is less at the left than at the right.
Figure 6B:
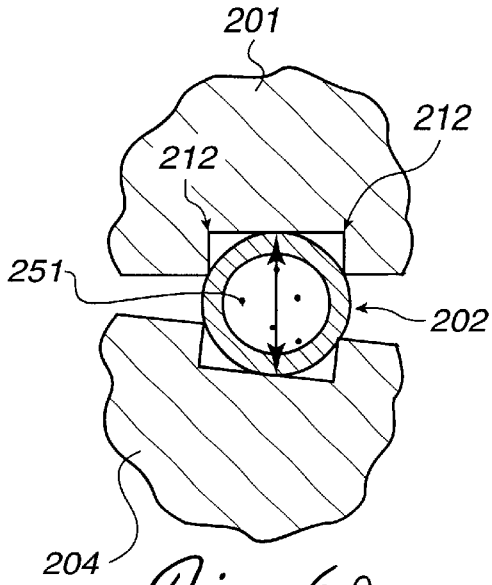
Figure 6C:
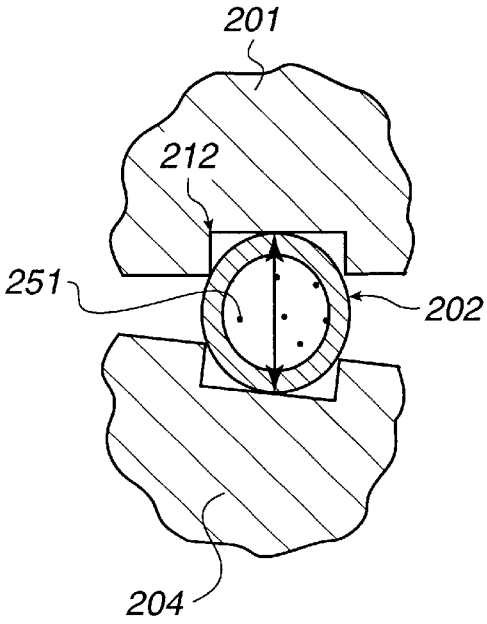

Generally, the active gimbal 202 is configured to have elastomeric and internal flow properties that enable the active gimbal 202 to respond to the unequal upward forces FUL and FUR and allow the above described tilting of the wafer plate 204 relative to the carrier plate 201. As used herein, an elastomeric material is generically an elastomer. In one embodiment of the present invention, the elastomer may be a polymer, such as polyurethane, silicone, or other synthetic rubber material. Synthetic rubber is typically a hydrocarbon polymeric material. The elastomer of the present invention preferably has the property of compressibility, which means that the elastomeric material can be compressed (or deformed) and store a restorative force. Having such compressibility (compression or deformation properties), and having the internal flow property, even after the elastomeric material is compressed by a force from an initial configuration (i.e., shape shown in FIG. 6D) to a compressed configuration (shown on the left in FIG. 6A), upon release of the force the restorative force of the elastomeric material (tending to return to the original configuration) is enhanced by the internal flow property so that the gimbal is able to quickly restore itself to the original configuration. In addition to the above exemplary elastomers, other embodiments of the present invention may use polyethylenes, olefins, fluoroplastics, polysulfones, and other materials having the above-described compressibility.

Figure 3:
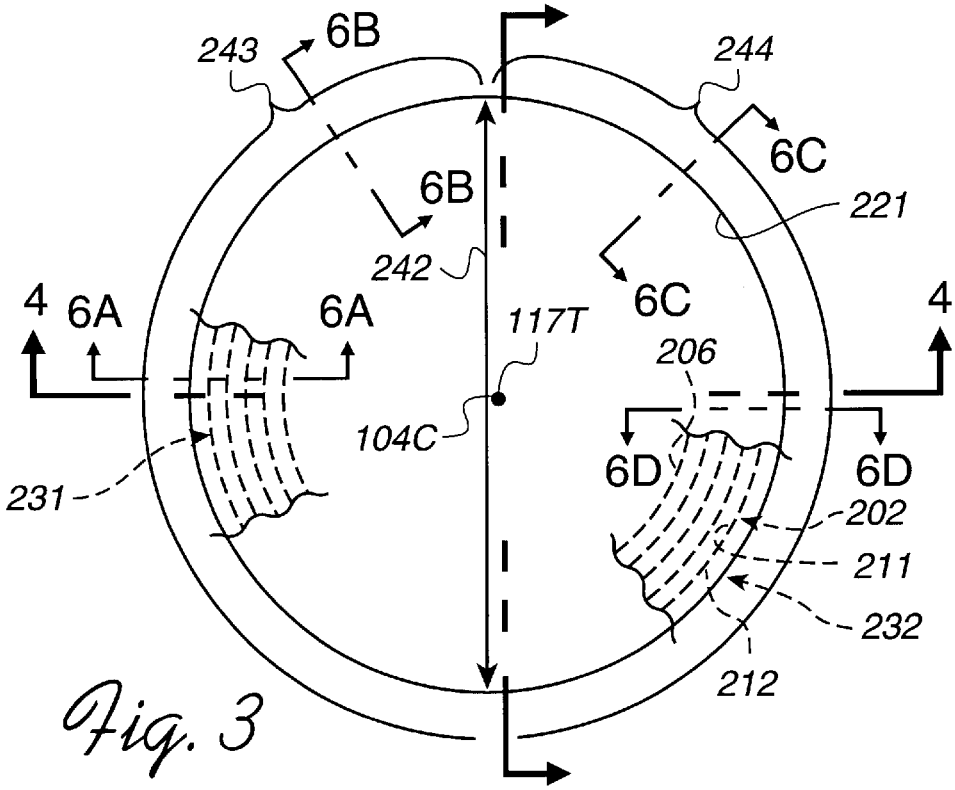
FIG. 3 is a cross sectional view taken along the lines 3—3 in FIG. 2 illustrating (in dashed lines) a hollow body received in a circular cavity defined between a carrier plate and a wafer plate of the carrier system, along with a wafer carried by the wafer plate.
Figure 4:
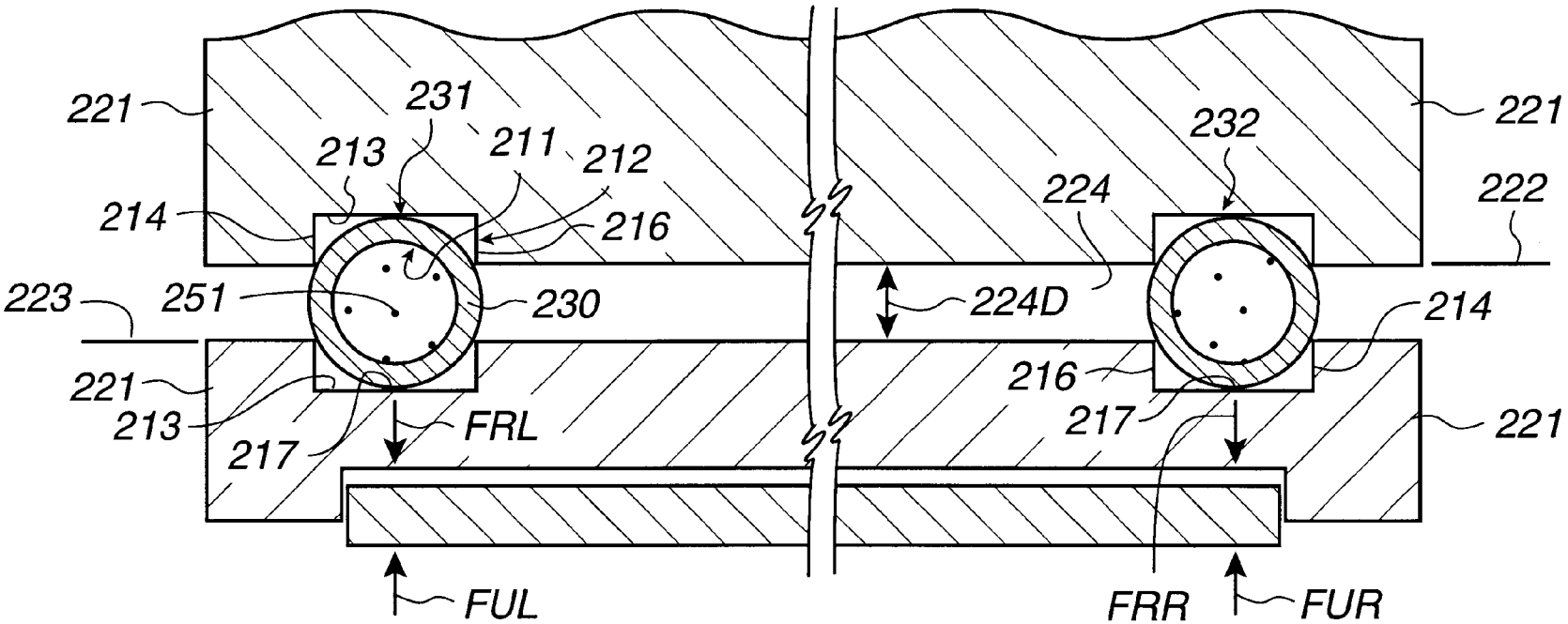
FIG. 4 is a cross sectional view taken along the lines 4—4 in FIG. 3 illustrating a plane defined by the carrier plate and a plane defined by the wafer plate, wherein the planes are parallel so that a first portion of the hollow body shown on the left of an axis of the carrier head has the same circular cross section as a second portion of the hollow body shown on the right of the axis.

FIG. 3 illustrates in dashed lines the gimbal 202 as including a hollow body 211 having the above-described elastomeric properties. The body 211 is received in a circular cavity 212 defined between the carrier plate 201 and the wafer plate 204 of the wafer carrier system 200. As more fully shown in FIG. 4, the cavity 212 is defined by a groove 213 in each of the carrier plate 201 and wafer plate 204. Each groove 213 is provided with an outer wall 214 and an inner wall 216, as well as a depth to a base 217. Alternatively, the grooves 213 may be configured with a semi-circular cross section. The cavity 212 is formed between the opposing grooves 213. FIGS. 3 and 4 also show the carrier plate 201 and the wafer plate 204 defining perimeter edges 221 and respective planes 222 and 223. The planes 222 and 223 are separated by a space 224 having a dimension 224D that is uniform when the planes 222 and 223 are parallel. FIG. 5 shows the space 224 having non-uniform dimensions 226 and 227 when the planes 222 and 223 are not parallel. As illustrated in FIG. 5, when the axes 104C and 117T are tilted through the angle 116A, around the axes 104C and 117T the areas of different cross sections of the cavity 212 varies. The variations are shown in FIGS. 5, and 6A–6D. FIG. 4 shows the area of the cavity 212 defined by the opposed grooves 213 having the spaced walls 214 and 216 and the base 217, and by the values of the respective dimensions 226 and 227 at a given angular position around the axes 104C and 117T. The volume of the cavity 212 is determined by integrating with respect to a circular cavity path partially shown in dashed lines in FIG. 3.

Figure 6D:
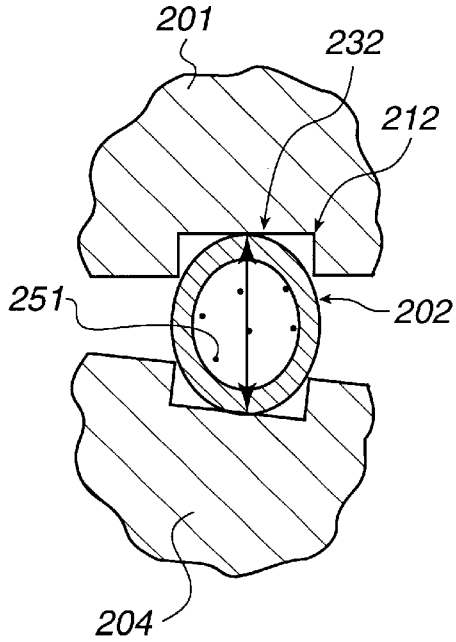

Continuing to refer to FIGS. 3–5, the hollow body 211 of the gimbal 202 may be configured as an annular, or toriodal, body (e.g., a ring). In the cross section shown in FIGS. 4, 5, and 6A–6D, the body 211 has an arcuate wall structure 230 (e.g., circular). FIG. 3 shows the structure 230 extending around and spaced inwardly from the peripheral edges 221, and radially spaced outwardly from the central axes 104C and 117T. The wall structure 230 may be described as having a first section 231 (shown in FIGS. 3 and 4) generally at one side of the axes 104C and 117T and adjacent to the opposite perimeter edges 221. The wall structure 230 has an opposite section 232 generally at an opposite side of the axes 104C and 117T and adjacent to the perimeter edges 221. FIG. 6D shows the original cross sectional configuration of the arcuate wall structure 230, which may be generally circular or slightly oval. When the hollow body 211 is placed in the cavity 212, and when the wafer plate 204 and the carrier plate 201 are movably joined, the structure 230 is somewhat deformed, i.e., compressed. For example, the respective first and second sections 231 and 232 are shown in FIG. 4 in an evenly deformed configuration when the planes 222 and 223 are parallel (i.e., when the dimension 224 is uniform across the planes 222 and 223). The cavity volume of the cavity 212 (as shown in FIG. 4) is also uniform around the circumference of the cavity 212. FIGS. 5, and 6A–D show the first and second sections 231 and 232 in unevenly deformed configurations when the planes 222 and 223 are not parallel. In the non-parallel situation, the dimension 224 is non-uniform between the planes 222 and 223, as indicated by the non-uniform dimensions 226 and 227 (FIG. 5). Thus, a portion of the entire cavity volume in which the first section 231 is received is a smaller volume than another portion of the cavity volume in which the second section 232 is received. In FIG. 5 the first section 231 is shown compressed by the left side of the cavity 212 having the smaller portion of the entire cavity volume and the second section 232 is shown decompressed, or relaxed, having returned to the original configuration as permitted by the other larger portion of the cavity volume (see also FIG. 6D). By comparing FIG. 4 with FIG. 5, it may be understood that when the planes 222 and 223 return to parallel, the first section 231 decompresses (from the compressed configuration of FIG. 5) and enlarges, still fitting closely in the cavity 212. On the other hand, as the planes 222 and 223 return to parallel, the first section 232 becomes compressed (from the original configuration of FIG. 5) and deforms into a smaller configuration, fitting closely in the cavity 212. FIGS. 6A–6D depict a series of cross-sectional views taken in FIG. 3 to illustrate the progressively increased amounts of the squeezing of the hollow body 211 around the circular length of the body 211, e.g., from the far right section 232 of the body 211 to the far left section 231 of the body 211.

Continuing to refer to FIGS. 3–5, the hollow body 211 of the gimbal 202 is further described as being received in a carrier plate-wafer support space, which is the space 224 between the carrier plane 222 and the support plane 223. The configuration of the body 211 is further described as shown in FIG. 3 in terms of a diameter 242 of the body 211. The diameter 242 divides the body 211 into a first half 243 (see bracket 243) that is squeezed, or deformed, when the planes 222 and 223 are not parallel, and into a second half 244 (see bracket 224) that is permitted to expand when the planes 222 and 223 are not parallel. The respective first and second halves 243 and 244 are configured to encompass substantially equal internal hollow wall volumes when the planes 222 and 223 are parallel and to encompass substantially unequal internal hollow wall volumes when the planes 222 and 223 are not parallel. The sum of the unequal internal wall volumes substantially equals the sum of the equal internal wall volumes. Such sums correspond to a first internal hollow wall volume of the body 211. Corresponding to the compression of the left section 231 shown in FIG. 5, the internal hollow wall volume of the first half 243 is less than the internal hollow wall volume of the second half 244 when the planes 222 and 223 are tipped as shown in FIG. 5.

The elastomeric material of which the gimbal body 211 is made is selected for a given thickness of the wall structure 230, and for given external and internal wall diameters, and for a given configuration of the cavity 212 (e.g., generally circular, or the spacing of walls 214 and depth to base 213). Such hollow body 211 having such wall thickness and such diameters and received in such cavity 212 will provide the appropriate compressibility (as defined above). That appropriate compressibility will assure that notwithstanding tilting of the axes 104C and 117T, the body 211 will urge itself into firm engagement with the cavity 212 (e.g., with the walls 214 and 216 and with the base 217 of the grooves 213). In one embodiment, the wall thickness may range between about 0.025 cm to about 0.1 cm, the internal diameter may range between about 0.5 cm to about 4 cm., and the external diameter may range between about 0.55 cm to about 4.2 cm. The compressibility is preferably selected for a given range of CMP process conditions, for example, downforces FD in the range of 1–7 psi.

Figure 7:
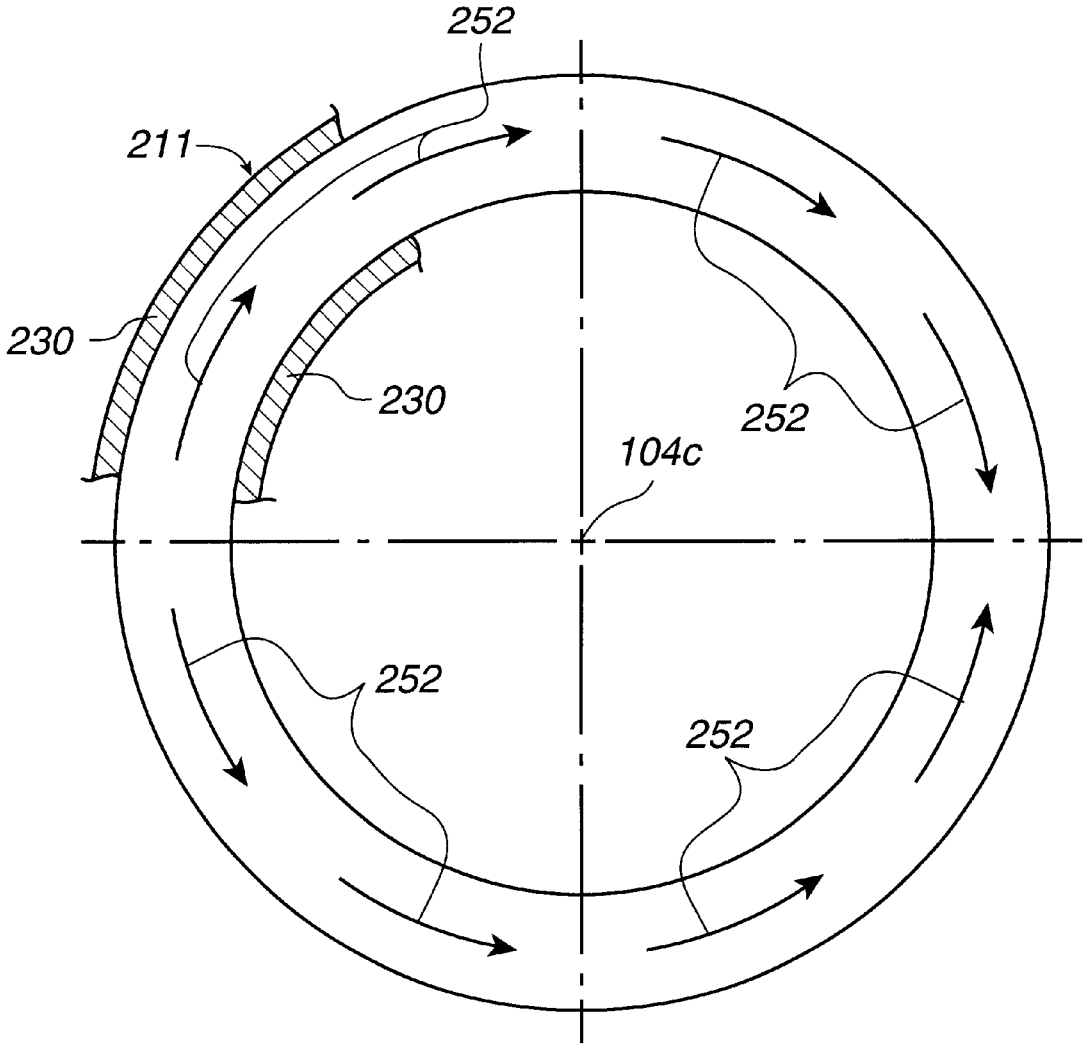
FIG. 7 is a cross sectional view taken along lines 7—7 in FIG. 5, illustrating the hollow body and a gel-like material received in and filling the body, wherein arrows depict the material flowing from the left squeezed section to the right, less-squeezed, section.

The internal flow property of the active gimbal 202 is described with respect to FIGS. 4, 5, and 6A–6D. These FIGS. illustrate the gimbal 202 as including the hollow body 211 filled with a gel-like material 251 (illustrated by many dots) having a flowable characteristic. In general, as the first and second sections 231 and 232 of the hollow body 211 initially become unevenly deformed (during initial tilting from the FIG. 4 position to the FIG. 5 tilted position) a portion of the gel-like material 251 is caused by the deformed first section 231 (or the deformed first half 243) to flow (see arrows 252 in FIG. 7) in the hollow body 211. The initial flow 252 is from the one side of the axes 104C and 117T to the second section 232 (or to the second half 244) at the opposite side of the axes 104C and 117T. The flow 252 of that portion maintains the now-larger cross-sectional areas of the second section 232, and the now-larger internal wall volume of the second half 244, filled with the gel-like material 251 while the deformed first section 231 remains filled with another portion of the gel-like material 251. The total amount of the gel-like material 251 received in and filling the hollow body 211 has a total gel volume about equal to the first internal hollow wall volume of the hollow body 211. The portion of the gel-like material 251 that initially flows in the hollow annular body 202 from the first section 231 to the second section 232, or from the first half 243 to the second half 244, reduces the volume of the gel-like material 251 in the first section 231 (or in the first half 243) and increases the volume of the gel-like material 251 in the second section 232 (or in the second half 244) to assist in keeping the active gimbal 202 tightly fitting in the space 224 all around the axes 104C and 117T. The tight fitting results from the cooperation of the compressibility of the hollow body 211 and the incompressibility and viscosity of the material 251. Thus, a greater force (e.g., FUL in FIG. 5) causes the flow 252 until a reactive force FRL of the body 211 equals the force FUL and until a reactive force FRR of the body 211 equals the force FUR. The equal respective forces FUL and FRL, and FRR and FUR, establish a force balance so that the planes 222 and 223 remain tilted until the polishing pad 209 applies different forces FUL and FUR to the wafer 206. Once the force balance has been established, the force balance continues because the gel-like material 251 continues to flow in a steady state condition in the hollow body 211 as the carrier plate 201 and the wafer late 204 continue to rotate in the tilted relative positions shown in FIG. 5, for example.

The internal flow properties of the active gimbal 202 relate to the viscosity of the gel-like material 251 received in and filling the hollow body 211. The viscosity is greater than that of water so that the material 251 impedes but still permits the described flow 252 of the portion of the gel-like material 251 in response to the reduction of the portion of the first cavity volume surrounding the first section 231. The viscosity also permits the described flow 252 of the portion of the gel-like material 251 into the second section 232 which is within the larger portion of the second cavity volume. The gel-like material 251 is incompressible, and the viscosity is selected to provide the flow 252 of the gel-like material 251 with a time constant. As described above the forces FUL and FUR may be unequal when applied to the wafer 206. As a result, the hollow body 211 is squeezed into the configuration shown in FIG. 5, for example, e.g., at a time TO. Because the internal volume of the body 211 adjacent to the lesser force FUR increases as the internal volume adjacent to the greater force FUL decreases, the flow 252 initially maintains the force FRL less than the force FUL and the force FRR less than the force FUR. Depending on the viscosity of the gel-like material 251, there is a short or long time period TR in which the gel-like material 251 flows in response to the initial squeezing of the hollow body 211. The time period TR is the period of time from time TO at which the forces FUL and FUR become unequal to a time TC at which each of the forces TUL and TUR is balanced by the respective resistive forces FRL and FRR of the body 211 on the wafer plate 204. When such force balance occurs, such flow 252 induced by the unequal forces TUL and TUR stops. As described above, once the force balance has been established, the force balance continues because of the steady state flow of the gel-like material 251 in the hollow body 211 as the carrier plate 201 and the wafer plate 204 continue to rotate. Such continued rotation is with the planes 222 and 223 non-parallel, such that as the section 232 having the large cross sectional configuration shown in FIG. 5 rotates toward the one hundred eighty degree opposite position of the section 231 shown in FIG. 5, the gel-like material 251 is squeezed and the steady state flow is around the ring and to the right in FIG. 5.

The rate at which such flow 252 occurs may be selected to be short or a long to provide various time periods TR during which the second section 232 becomes filled and the force balance is achieved. In terms of the second half 244, such flow 252 may take a short or a longer period of time TR to arrive at and completely fill the second half 244. The time constant of the gel-like material 251 allows a fast response to the forces FUL and FUR becoming unequal, so as to avoid the edge effect problems described above. Further, the time constant also tends to dampen, or slow down, the effect of the unequal forces FUL and FUR applied to the wafer 206 so as to avoid vibration, e.g., of the wafer plate 204 relative to the carrier plate 201.

In a preferred embodiment of the gel-like material 251, the material may be a silicone-based gel-like fluid. In a more preferred embodiment, the gel-like material 251 may be a dimethyl fluid such as that sold by Applied Silicone Corporation under the trademark RHODORSIL, as model 47V100,000 fluid. At an operating temperature of the system 200 the viscosity of the gel-like material 251 may be in the range of about 200 centipoise (cP) to about 20,000 cP. It is to be understood that the particular viscosity that is selected will depend on the dynamics of the particular system 200, which in turn may depend on the type of polishing pad 209 that is used. Also, the viscosity of the gel-like material 251 may be adjusted before or during a CMP operation by varying the temperature of the carrier plate 201 and/or of the wafer plate 204, such as by providing a thin heater adjacent to or in the grooves 213. The heater may be a resistance heater powered by electricity controlled by the system 200 and supplied to the carrier plate 201, for example.

The carrier plate 201 and the wafer plate 204 may be held together by standard drive pins, for example. Typically, from one to three such pins are used and may extend from the carrier plate 201 into a drive slot in the wafer plate 204.

Figure 8:
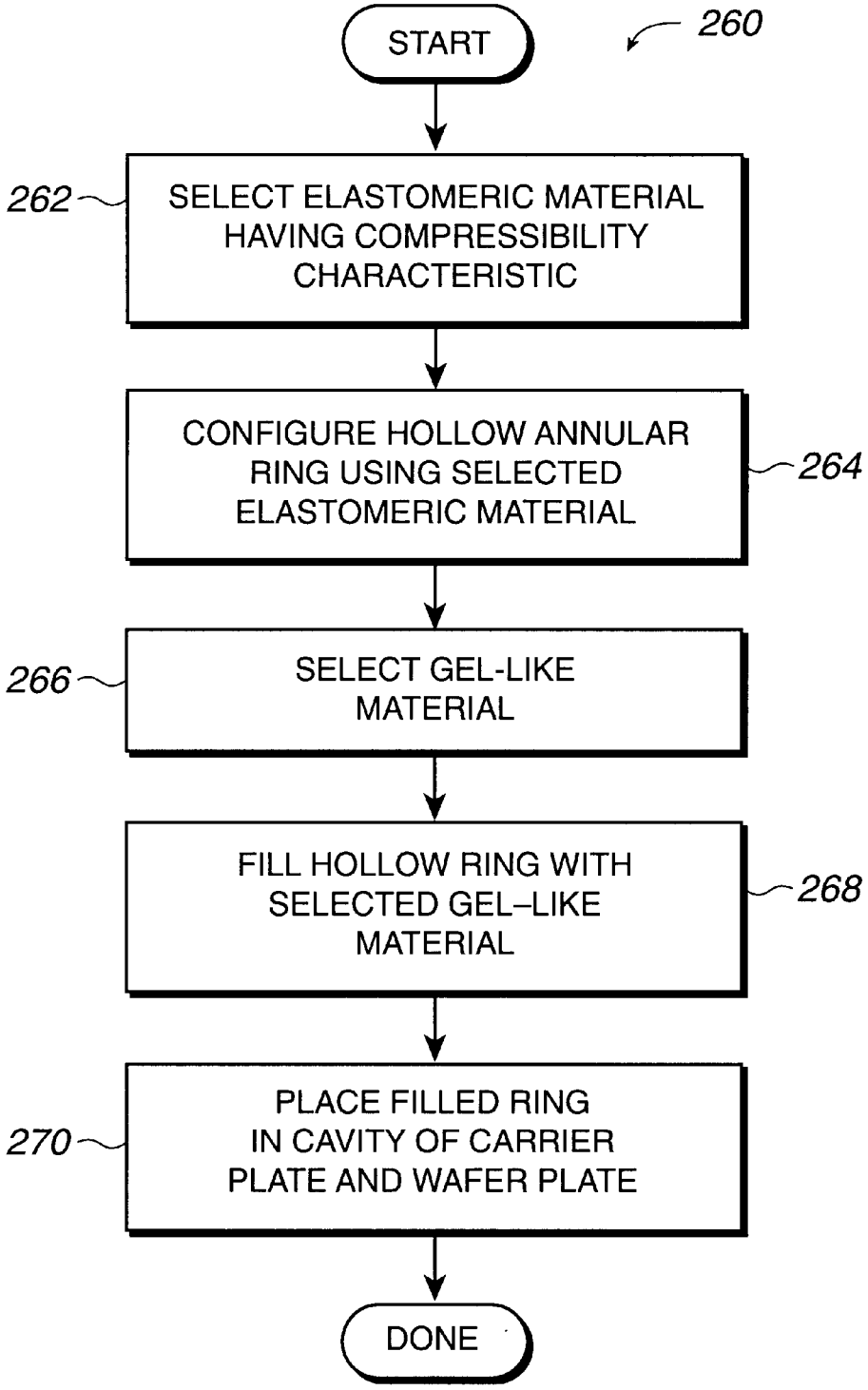
FIG. 8 is a flowchart diagram of a process of making an active gimbal of the present invention.

FIG. 8 shows a flowchart diagram of the method, or process, 260 of making the active gimbal 202 of the present invention. The method begins at an operation 262 in which an elastomeric material is selected to have the compressability characteristic suitable for response to CMP forces. As described above, the elastomeric material of the present invention may be an elastomer having such compressibility characteristic. Such material may be the material described above with respect to the hollow body 211. The body 211 configured with such elastomeric material is described above with respect to FIGS. 4 and 5 which show various compression and decompression (restorative) situations. The method moves to an operation 264 in which a hollow annular ring is configured for reception in a cavity defined in opposed spaced surfaces of a carrier plate and a wafer plate. The configuring of the ring uses the selected elastomeric material, which may be placed in a suitably shaped mold and cured. The ring may correspond to the hollow body 211 described above. The CMP carrier plate and wafer plate may be the plate 201 designed to mate with the wafer plate 204 and carry the wafer 206, as described above. The wafer plate 204 applies the wafer 206 against the surface 208 of the polishing pad 209 during planarization operations in which the forces FUR and FUL may be applied to the wafer 206. The method moves to an operation 266 in which a gel-like material is selected having a viscosity suitable for dampening the CMP forces applied to a CMP carrier plate and a wafer plate. The CMP carrier plate and the wafer plate may be the carrier plate 201 and the wafer plate 204, as described above. The gel-like material may be the gel-like material 251 described above with respect to the flow 252 in response to the unequal forces FUR and FUL applied to the wafer 206, which result in the hollow body 211 being squeezed and causing such flow 252. The method moves to an operation 268 in which the hollow annular ring is filled with the selected gel-like material. Operation 268 may be performed, for example, by filling the hollow body 211 with the gel-like material 251. Such filling may, for example, be by evacuating the hollow body 211 to a fully collapsed condition, and under the control of a fill valve backfilling the hollow body 211 with a pre-set volume of the gel-like material 251. As described above, the total amount of the gel-like material 251 received in and filling the hollow body 211 has a total gel volume about equal to the first internal hollow wall volume of the hollow body 211. The method moves to an operation 270 in which the filled ring is placed in a cavity defined between a carrier plate and a wafer plate. The CMP carrier plate and the wafer plate may be the carrier plate 201 and the wafer plate 204, as described above, which have the cavity 212. The method is thus done, and the exemplary carrier plate 201 and wafer plate 204, with the exemplary hollow body 211 filled with the gel-like material 251 and positioned in the cavity 212, may be used in CMP processing of the wafer 206.

The present invention has many advantages. Compared to the above prior gimbals 111 having complexity of the mechanical components which makes such gimbals difficult to design and implement for symmetric repetitive CMP environments, the present gimbal 202 has a simpler structure. For example, once a suitable cavity 212 is provided in the carrier plate 201 and the wafer plate 204, the selection of materials for the hollow body 211 and gel-like material 251 may be performed and the hollow body 211 prepared by molding, for example. Further, once the filled hollow body 211 is inserted in the cavity 212, in the CMP operations the only movement of the gimbal 202 are the described change in configuration (cross sectional shape) of the body 211 in response to the CMP forces, such as the unequal forces FUL and FUR, the resulting flow 252 of the material 251 within the body 211, and the described steady state flow of the material 251. With the selected elastomer for the hollow body 211 and the selected viscosity of the material 251, the gimbal 202, is designed to minimize vibration problems of the prior typical gimbals 111 in response to the forces of the polishing pad 107 and the wafer 103. With the vibrations minimized, there is a reduction in inappropriate CMP results in processed wafers. Also, the dampening provided by the gel-like material 251 assists in substantially eliminating the damaging edge-effects and their associated removal rate non-uniformities.

Although the foregoing invention has been described in some detail for purposes of clarity of understanding, it will be apparent that certain changes and modifications may be practiced within the scope of the appended claims. For instance, the elastomeric material can by of any type, so long as it can be compressed and, once applied force is reduced, the elastomeric material will return to its original uncompressed position. Also, the gel-like material may be any type, so long as it provides flow characteristics allowing suitable flow in response to the unequal forces FUL and FUR. Accordingly, the present embodiments are to be considered as illustrative and not restrictive, and the invention is not to be limited to the details given herein, but may be modified within the scope and equivalents of the appended claims.

What is claimed is:

1. In a chemical mechanical planarization (CMP) system having a carrier body for applying force along a central axis and a retainer body for holding a wafer centered on the axis, the wafer having a peripheral edge, the carrier body and the retainer body each defining a perimeter edge and a plane, the planes being separated by a space having a uniform dimension when the planes are parallel and having a non-uniform dimension when the planes are not parallel, and an active gimbal received in the space, the active gimbal comprising:

a hollow annular body configured with an arcuate wall structure, the body extending around and being radially spaced outwardly from the central axis, the body being co-axial with the peripheral edge of the wafer, the body being configured with a first section generally at one side of the axis and adjacent to the perimeter edges and with a second section generally at an opposite side of the axis and adjacent to the perimeter edges, the first and second sections being unevenly deformed when the space has the non-uniform dimension; and a gel-like material received in and filling the hollow annular body so that when the first and second sections are unevenly deformed a portion of the gel-like material is caused by the deformed first section to flow in the hollow annular body from the one side of the axis to the second section at the opposite side of the axis to fill the deformed second section with the gel-like material while allowing the deformed first section to remain filled with another portion of the gel-like material.

2. An active gimbal as recited in claim 1, wherein:

the wall structure is fabricated from an elastomeric material;

the arcuate wall structure has a hollow generally circular cross section when the planes are parallel;

the wall structure has a first internal volume evenly distributed around the axis when the planes are parallel;

the first section has the hollow generally circular cross section in a first deformed configuration, the first configuration has a reduced internal volume when the planes are not parallel;

the second section has the hollow generally circular cross section in a second deformed configuration, the second configuration has an increased internal volume when the planes are not parallel;

the first and second configurations being unevenly deformed; and the gel-like material is taken from the group consisting of silicone-based gel-like fluids and dimethyl fluids.

3. An active gimbal as recited in claim 2, wherein:

the gel-like material received in and filling the hollow generally circular cross section of the wall structure has a volume about equal to the first internal volume;

the gel-like material has a viscosity characteristic and a time constant flow characteristic; and the time constant flow characteristic is variable according to a value of the viscosity characteristic, the time constant flow characteristic represents the amount of time required for the gel-like material to flow from the first section having the reduced internal volume and fill the second section having the increased internal volume.

4. An active gimbal as recited in claim 1, wherein:

each of the carrier body and the retainer body is provided with a groove that extends through the respective plane defined by the respective carrier body and retainer body and extends circularly around the central axis and having a diameter less that that of the respective perimeter edges so that each of the grooves is closely adjacent to the respective perimeter edge, each of the grooves having an outer wall and an inner wall, the respective outer wall and inner wall of one groove is disposed opposite to the respective outer wall and inner wall of the other groove to define a cavity, and the hollow annular body is received in the cavity compressed into an evenly deformed configuration when the space has the uniform dimension.

5. An active gimbal as recited in claim 4, wherein a volume encompassed by the cavity has a first cavity volume portion adjacent to the first section and a second cavity volume portion adjacent to the second section, and wherein the first cavity volume portion is reduced and the second cavity volume portion is increased when the first and second sections of the body are unevenly deformed; and wherein:

the reduced first cavity volume portion further compresses the first section and the second section is allowed to be decompressed by the increased second cavity volume portion; and in response to the further compression of the first section and the decompression of the second section there is the flow of the gel-like material in the hollow annular body from the first section to the second section.

6. An active gimbal as recited in claim 1, wherein:

the planes are not parallel in response to a first force applied to the body on one side of the central axis and a second force applied to the body on another side of the central axis, the first and second sections of the body and the gel-like material in the body receive unbalanced forces in response to the first and second forces;

the active gimbal further comprising:

a heater, the heater and the gel-like material being positioned in heat transfer relationship; and wherein:

the gel-like material received in and filling the hollow annular body has a viscosity, wherein the viscosity is greater than that of water and varies according to the temperature of the gel-like material;

the gel-like material has a temperature that is selected according to the amount of heat transferred to the material by the heater that is in heat transfer relationship with the material, and the gel-like material has a characteristic that the flow of the gel-like material in the hollow annular body has a time constant selected according to the viscosity of the gel-like material to impede but still permit the flow of the portion of the gel-like material from the first section to the second section, the time constant representing a period of time after the first and second forces are applied to the body in which the material flows from the deformed first section to the deformed second section until the first and second forces become balanced.

7. An active gimbal for allowing a carrier plate-wafer support plate space to vary in configuration as the carrier plate and the wafer support plate tilt relative to a central axis during CMP processing, the active gimbal comprising:

a hollow toroidally-shaped body configured for reception in the carrier plate-wafer support plate space and between a carrier plane defined by the carrier plate and a support plane defined by the wafer support plate, the configuration of the body being a generally circular shape that extends around and is radially spaced from a co-axial center of the carrier plate and the wafer support plate, the toroidally-shaped body being configured so that a diameter of the body divides the body into a first hollow half that is squeezed when the planes are not parallel and into a second hollow half that is permitted to expand when the planes are not parallel, the respective first and second hollow halves being configured to encompass substantially equal volumes when the planes are parallel and to encompass substantially unequal volumes when the planes are not parallel, wherein the sum of the unequal volumes substantially equals the sum of the equal volumes; and a gel-like material taken from the group consisting of silicone-based gel-like fluids and dimethyl fluids, the material filling the hollow toroidally-shaped body, the gel-like material being substantially incompressible so that as the first and second hollow halves encompass the substantially unequal volumes when the planes are not parallel a portion of the gel-like material is caused to flow in the hollow body from the first hollow half to the second hollow half to fill the encompassed unequal volumes, the gel-like material in the unequal volumes maintaining the hollow toroidally-shaped body in contact with each of the carrier plate and the wafer support plate when the planes are not parallel.

8. An active gimbal as recited in claim 7, wherein:

the carrier plane and the support plane define opposed sides of a gimbal motion space;

each of the opposed sides is provided with a groove extending in a circular cavity path;

the respective grooves also extend through the respective planes defined by the respective carrier plane and support plane;

the respective grooves are directly opposed to each other and define a circular cavity extending around the central axis so that each groove receives a portion of the hollow toroidally-shaped body;

the first and second halves of the body and the respective grooves defining the cavity are configured so that when the planes are parallel the cavity defined by the directly opposed grooves equally compresses and confines the respective received first and second halves of the body to allow the equally compressed halves to encompass the substantially equal volumes;

the first and second halves of the body and the respective grooves defining the cavity are further configured so that when the planes are not parallel the cavity further compresses and confines the first half and allows the second half of the body to decompress to allow the respective first and second halves to encompass the respective substantially unequal volumes; and the gel-like material filling the unequally compressed and decompressed respective first and second halves of the body flows in the hollow body from the first half to the second half.

9. An active gimbal as recited in claim 7, wherein:

the gel-like material filling the hollow toroidally-shaped body has a gel volume about equal to a first internal volume encompassed by the substantially equal volumes so that as the first half is squeezed by a first force a portion of the gel-like material flows in the hollow body from the first half to the second half that is subject to a second force less that the first force to reduce the volume of the gel-like material in the first half and increase the volume of the gel-like material in the second half to keep the active gimbal tightly received in the space when the planes are not parallel;

the gel-like material has a viscosity characteristic and a time constant flow characteristic; and the time constant flow characteristic is variable according to a value of the viscosity characteristic, the time constant flow characteristic represents the amount of time, from an initial time of application of the first and second forces to the respective first half and second half, to a later time at which the gel-like material has flowed from the squeezed first half into the expanded second half, which later time occurs when the first and second forces have become balanced.

10. An active gimbal as recited in claim 7:

wherein a first force applied to the body on one side of the central axis and a second force applied to the body on another side of the central axis cause the carrier plane and the support plane to not be parallel;

wherein the first and second halves of the body and the material in the body receive unbalanced forces in response to the first and second forces;

the active gimbal further comprising:

a heater, the heater and the gel-like material being positioned in heat transfer relationship; and wherein:

wherein the gel-like material filling the hollow toroidally-shaped body has a viscosity that is greater than that of water and varies with the temperature of the material;

the gel-like material has a temperature selected according to the amount of heat transferred by the heater to the gel-like material; and the gel-like material has a time constant flow characteristic, the time constant flow characteristic represents the duration of a period of time starting at a first time upon application of the first and second forces to the body and ending when the first and second forces become balanced, which time constant flow characteristic governs the duration of response of the body to the unbalanced force.

11. A method of making a gimbal for use in a chemical mechanical planarization (CMP) carrier head, the gimbal being configured to be positioned between the carrier head and a wafer carrier, the carrier head and the wafer carrier each defining a plane, the planes normally being spaced and parallel, the method comprising the operations of:

selecting an elastomeric material having compression and decompression characteristics suitable for response to CMP forces;

configuring each of the carrier head and the wafer carrier with an annular groove, each groove having a wall provided with a semi-circular cross section, the respective grooves being directly opposed to each other so that the walls define a cavity having a uniform cavity cross sectional area and a uniform cavity volume around a circumference of the cavity when the planes are parallel and having a non-uniform cavity volume around the circumference when the planes are not parallel;

configuring a hollow toroidally-shaped ring for reception in the cavity, the ring being configured from the selected elastomeric material, the configuring of the ring being such as to define a hollow generally circular uniform ring cross section having a uniform ring cross sectional area that is greater than the uniform cavity cross sectional area;

selecting a gel-like material from the group consisting of silicone-based gel-like fluids and dimethyl fluids, the fluids having a viscosity suitable for dampening the CMP forces applied to the carrier head and the wafer carrier; and filling the hollow toroidally-shaped ring with the selected gel-like material.

12. A method as recited in claim 11, comprising the further operation of:

placing the filled hollow toroidally-shaped ring into the cavity between the carrier head and the wafer carrier to cause the uniform ring cross section to be compressed by the walls so that the uniform ring cross sectional area is reduced uniformly along the length of the ring around the circumference of the cavity.

13. A method as recited in claim 11, wherein:

the selected silicone-based gel-like material has a viscosity that is greater than that of water and that varies with temperature;

the silicone-based material has a time constant flow characteristic;

in the use of the gimbal unevenness of the CMP forces may cause the planes to not be parallel so that the non-uniform cavity volume exists around the circumference of the cavity;

the cavity having the non-uniform cavity volume reduces the volume of the silicone-based material in a first compressed configuration of the toroidally-shaped ring and allows an increase in the volume of the silicone-based material in a second decompressed configuration of the toroidally-shaped ring;

the time constant flow characteristic represents the amount of time measured from a first time at which the CMP forces become uneven, the amount of time being that required for the silicone-based material to flow from the first compressed configuration to the second decompressed configuration and fill the second decompressed configuration; and heating the silicone-based material in the toroidally-shaped ring to adjust the temperature and the time constant flow characteristic of the silicone-based material.

14. A method as recited in claim 11, wherein:

the selected elastomeric material is taken from the group consisting of synthetic rubber, olefin, fluoroplastic, and polysulfone.

15. A method of making an active gimbal for allowing a wafer support to tilt with respect to a carrier plate during CMP processing, the method comprising the operations of:

configuring a hollow body for reception in a space between the carrier plate and the wafer support, the configuring providing the body with a hollow ring shape extending around and radially spaced from co-axial centers of the carrier plate and the wafer support, the ring-shaped body being configured so that a diameter of the body divides the body into a first half that is compressed when planes defined by the respective carrier plate and wafer support are not parallel and into a second half that is permitted to decompress when the planes are not parallel, the configuring allowing the first and second halves to encompass substantially equal volumes when the planes are parallel and to encompass substantially unequal volumes when the planes are not parallel, wherein the sum of the unequal volumes substantially equals the sum of the equal volumes; and filling the hollow ring-shaped body with a gel-like silicone-based fluid that is substantially incompressible, that has a viscosity characteristic that is greater than that of water, the viscosity characteristic being variable with temperature and having a time constant flow characteristic, the time constant flow characteristic being variable according to a value of the viscosity characteristic, the time constant flow characteristic representing an amount of time after a first time at which a force causes the planes to be not parallel, the amount of time being that required for the gel-like silicone-based fluid to flow in response to the compressed first half and fill the decompressed second half, wherein the gel-like silicone-based fluid having the viscosity characteristic and time constant flow characteristic impedes but still permits flow of the gel-like silicone-based fluid from the compressed first half to the second decompressed half when the planes are not parallel.

16. A method as recited in claim 15, wherein:

the viscosity of the gel-like silicone-based material is in the range from about 200 cP to about 20,000 cP.

17. A method as recited in claim 15, further comprising the operation of:

controlling the temperature of the gel-like silicone-based fluid in the hollow ring-shaped body to provide a desired viscosity and time constant flow characteristic of the gel-like silicone-based fluid.

* * * * *